US010923851B2

(12) United States Patent
Betterridge et al.

(10) Patent No.: US 10,923,851 B2
(45) Date of Patent: Feb. 16, 2021

(54) OUTDOOR ELECTRICAL PLUG AND SOCKET COVER

(71) Applicant: AMPFIBIAN HOLDINGS PTY LTD, Ballina (AU)

(72) Inventors: David Betterridge, Ballina (AU); Oliver Robert Clemens Kratzer, Ballina (AU)

(73) Assignee: AMPFIBIAN HOLDINGS PTY LTD, Ballina (AU)

( * ) Notice: Subject to any disclaimer, the term of this patent is extended or adjusted under 35 U.S.C. 154(b) by 0 days.

(21) Appl. No.: 16/338,985

(22) PCT Filed: Oct. 3, 2017

(86) PCT No.: PCT/AU2017/000206
§ 371 (c)(1),
(2) Date: Apr. 2, 2019

(87) PCT Pub. No.: WO2018/064706
PCT Pub. Date: Apr. 12, 2018

(65) Prior Publication Data

US 2020/0044383 A1 Feb. 6, 2020

(30) Foreign Application Priority Data

Oct. 4, 2016 (AU) ..... 2016904008

(51) Int. Cl.
*H01R 13/62* (2006.01)
*H01R 13/58* (2006.01)
(Continued)

(52) U.S. Cl.
CPC ..... *H01R 13/5205* (2013.01); *H01R 13/501* (2013.01)

(58) Field of Classification Search
CPC ..... H01R 13/639; H01R 13/5833; H01R 13/5804; H01R 13/436; H01R 13/506; H01R 13/58; H01R 23/025
(Continued)

(56) References Cited

U.S. PATENT DOCUMENTS 5,217,387 A * 6/1993 Hull ..... H01R 13/6392 439/367
6,036,526 A * 3/2000 Alfis, III ..... H01R 4/70 439/369
(Continued)

FOREIGN PATENT DOCUMENTS

AU 2010100095 A4 3/2010
AU 201339744 B2 4/2015
(Continued)

OTHER PUBLICATIONS

International Search Report and Written Opinion dated Dec. 18, 2017, issued in International Patent Application No. PCT/AU2017/000206, filed Oct. 3, 2017, 9 pages.

*Primary Examiner* — Abdullah A Riyami
*Assistant Examiner* — Thang H Nguyen
(74) *Attorney, Agent, or Firm* — Davis Wright Tremaine LLP; Michael J. Donohue

(57) ABSTRACT

A weather proof cover for electrical plug and socket junction which is shaped to accommodate the socket and plug between two hinged parts and provide a weather seal about each power cord associated with the plug and socket said cover including a hinge section joining the two parts along adjacent longitudinal edges, fastening means on the longitudinal edges opposite the hinge edges to securely close the cover, the seals around the power cords located on the end edges of each part, cord gripping devices located on the internal surface of one of said parts to prevent movement of the cords when the cover is closed without applying tension
(Continued)

to the attachment of the cords to the plug or socket. The improvement being the provision of a lead restraint mechanism within the space between the two parts.

13 Claims, 14 Drawing Sheets

(51) Int. Cl.
*H01R 13/52* (2006.01)
*H01R 13/50* (2006.01)

(58) Field of Classification Search
USPC ..... 439/369, 458, 471, 460, 278
See application file for complete search history.

(56) References Cited

U.S. PATENT DOCUMENTS 7,285,725 B1 * 10/2007 Saman ..... H01R 13/5221 174/84 R
7,553,181 B1 * 6/2009 Van Dalinda, III ..... H01R 13/6392 174/92
8,035,955 B2 * 10/2011 Parks ..... B27B 5/29 361/679.01
2008/0054743 A1 * 3/2008 Doumani ..... B25F 5/006 310/71
2009/0004909 A1 * 1/2009 Puzio ..... B27B 5/29 439/460
2011/0207362 A1 * 8/2011 Lifson ..... H01R 13/6392 439/369
2011/0275233 A1 * 11/2011 Benear ..... H01R 13/52
2015/0056847 A1 * 2/2015 Liu ..... F16L 3/13 439/471
2018/0358724 A1 * 12/2018 Loew ..... H01R 13/506

FOREIGN PATENT DOCUMENTS

EP 1965471 A2 9/2008
WO 03/001631 A1 1/2003

* cited by examiner

OUTDOOR ELECTRICAL PLUG AND SOCKET COVER

This invention relates to an improved environmental cover for an electrical housing for extension lead plugs and sockets which are connected in an envoromentally exposed location.

BACKGROUND TO THE INVENTION

A difficulty with connecting extension leads outdoors is that the leads and plug connections are exposed to the elements and water seeping into the plug and socket connection may result in a dangerous short circuit.

Many patents have addressed the problem of enclosing electrical connectors.

The most relevant of these use clam shell configurations with a hinge parallel to the cable. Examples are U.S. Pat. Nos. 5,217,387, 6,036,526, 7,285,725, 7,553,181 and WO03001631. Australian patent 2010100095 by the present applicant discloses an alternative longitudinal clam shell enclosure.

However none of these provide effective environmental sealing around the cable which is capable of accommodating a range of cable sizes. Another problem with plugs and sockets on extension leads is that separation of the plug and socket may occur because of force applied to the lead. In prior art enclosures this force was resisted by a bracket that abutted the plug or socket but did not prevent the possibility of damaging the connection between the lead and the plug or socket.

It is an object of this invention to provide protective cover that ameliorates these problems.

BRIEF DESCRIPTION OF THE INVENTION

To this end the present invention provides a cover having two parts hinged along one longitudinal side and able to be clipped together on the opposite longitudinal sides; the space between the two parts being able to accommodate an electrical plug and lead and an associated electric plug and lead; the leads extending through sealed apertures in the two opposed ends of the closed cover between the hinged side and the clipped side; the improvement being the provision of a lead restraint mechanism within the space between the two parts.

Preferably the restraint mechanism is located in one of said parts and there is a restraint for each lead. Preferably the restraint grips the surface of the lead and is releasable when the cover is opened. Closure of the cover locks the restraint so that pulling on a lead will not separate the socket and plug or force open the cover and will not damage the electrical connection between the lead and the plug or socket. The edges of the two parts when closed form a weather proof seal about the space within the cover. The apertures through which the leads pass are also resiliently sealed and may utilise the applicants seal disclosed in Australian patent 2014339744.

In another aspect this invention provides weather proof cover for electrical plug and socket junction which is shaped to accommodate the socket and plug between two hinged parts and provide a weather seal about each power cord associated with the plug and socket said cover including a hinge section joining the two parts along adjacent longitudinal edges, fastening means on the longitudinal edges opposite the hinge edges to securely close the cover, the seals around the power cords located on the end edges of each part, cord gripping devices located on the internal surface of one of said parts to prevent movement of the cords when the cover is closed without applying tension to the attachment of the cords to the plug or socket. The cord gripping mechanism is actuated on closing the cover by bringing the two hinged parts together.

DETAILED DESCRIPTION OF THE INVENTION

A preferred embodiment of the invention will now be described with reference to the drawings in which FIG. 1 shows a perspective view of a closed outdoor cover of this invention;

Figure 7:
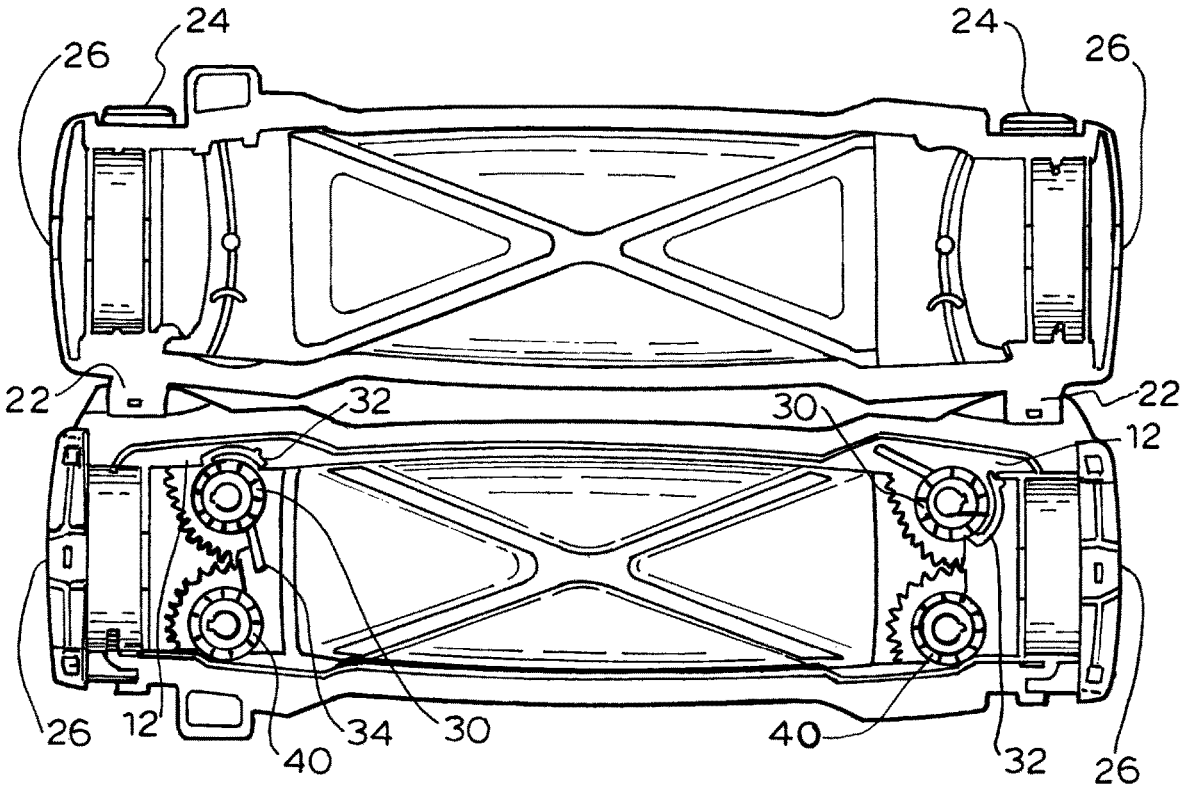
FIG. 7 shows a plan view of the opened cover of this invention.

The external appearance of the cover is shown in FIGS. 1 to 6 and the opened cover is shown in FIG. 7.

Figure 1:
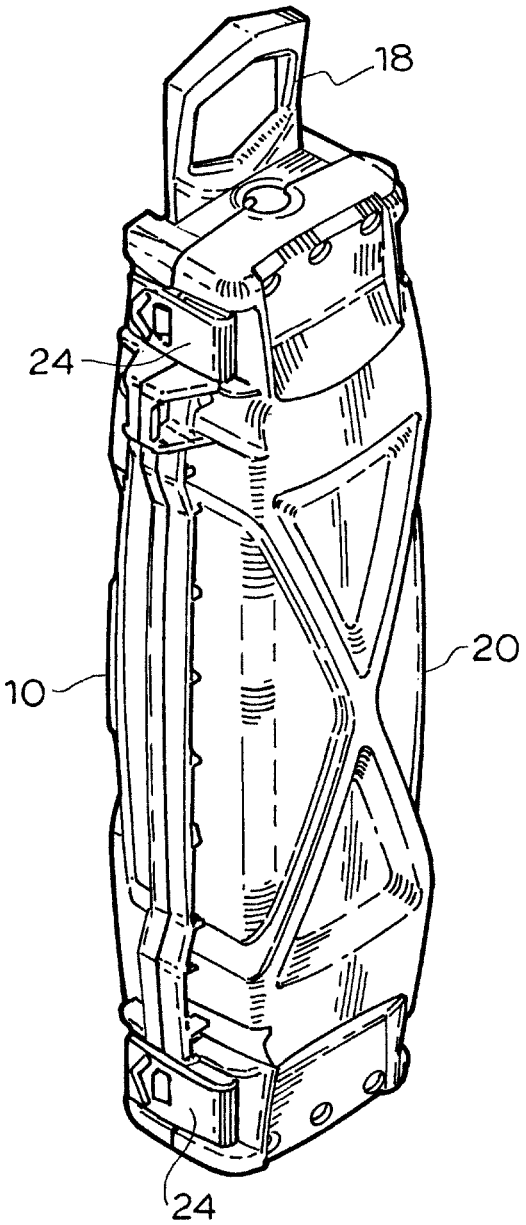
Figure 2:
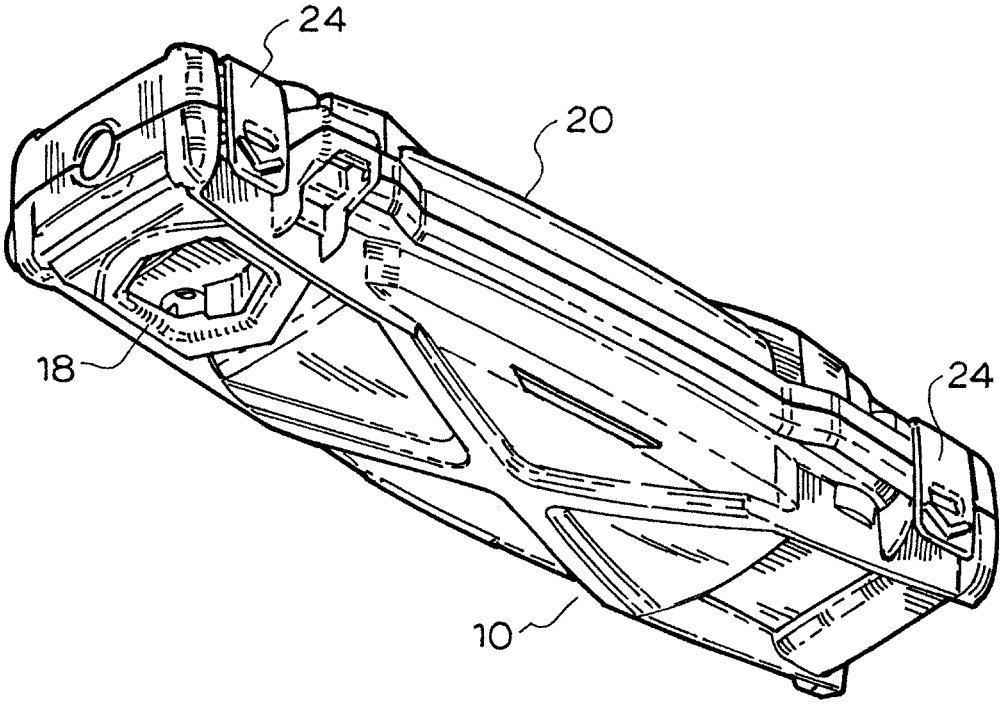
FIG. 2 shows a perspective view with the attachment bracket retracted.
Figure 3:
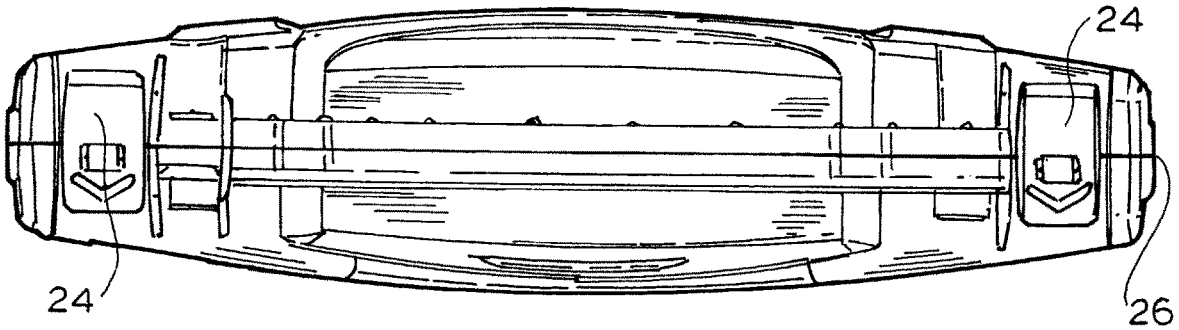
FIG. 3 shows a side elevation of the closed cover on the clip side.
Figure 4:
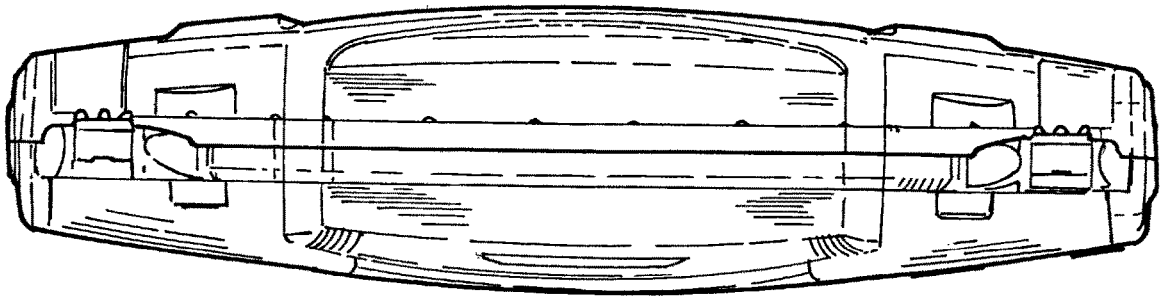
FIG. 4 shows a side elevation of the closed cover on the hinge side.
Figure 5:
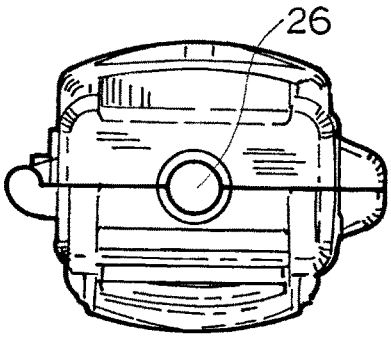
FIG. 5 shows one end of the closed cover.
Figure 6:
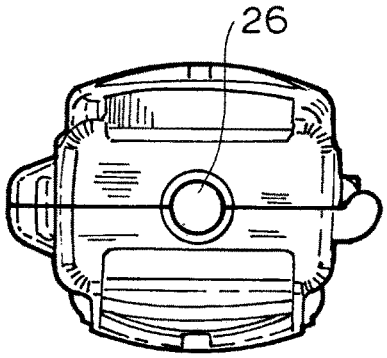
FIG. 6 shows the other end of the closed cover.

The cover consists of a body part 10 and a lid 20 hinged by hinges 22 to the body 10. When the cover is closed the clips 24 on lid 20 engage the ribs 13 on the external surface of the body 10 to securely close the cover. A bracket 18 for suspending the cover is located on the external surface of the body 10 and may be extended as shown in FIG. 1 or retracted as shown in FIG. 2.

The socket and plug connected together are accommodated in the interior space in the central portion between the lid 20 and body 10. The electrical leads 50 extend out of the cover through the apertures 26 formed between the ends 15 of the closed body and ends 25 of the closed lid.

Figure 10:
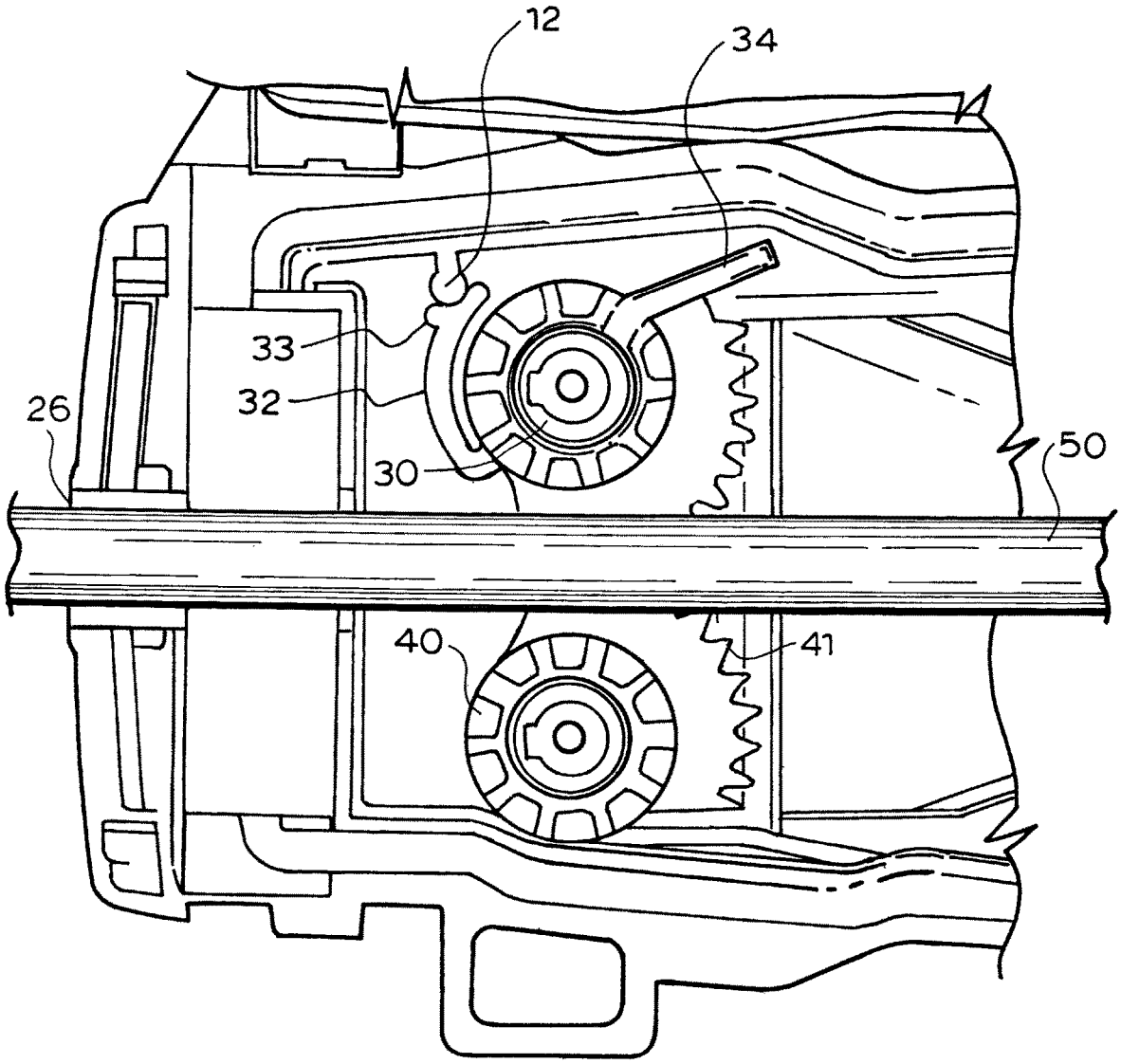
FIG. 10 shows a detail view of the electrical cord held in the cleat mechanism.
Figure 11:
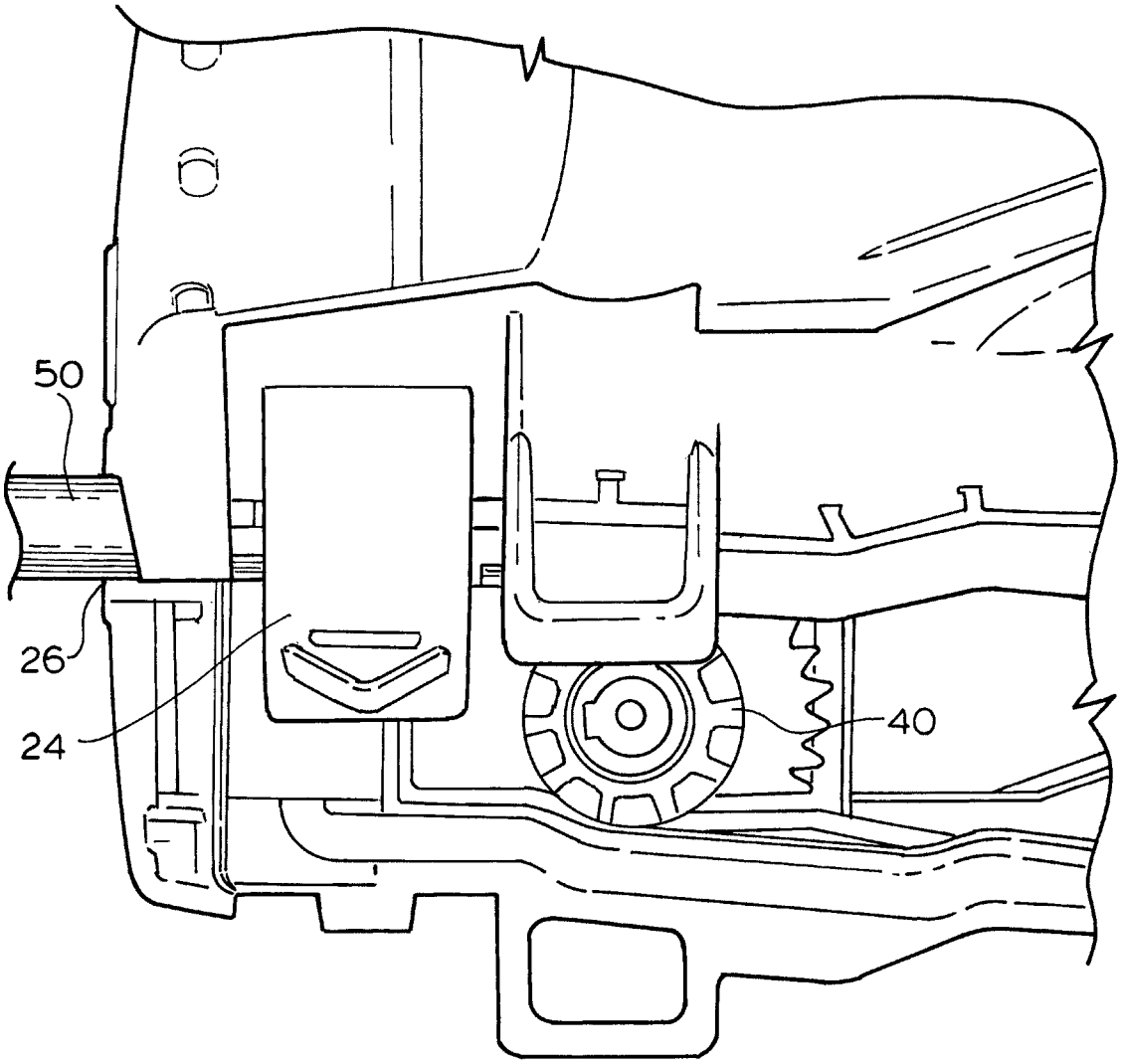
FIG. 11 is a view of the closing of the cover about an electrical cord.
Figure 12:
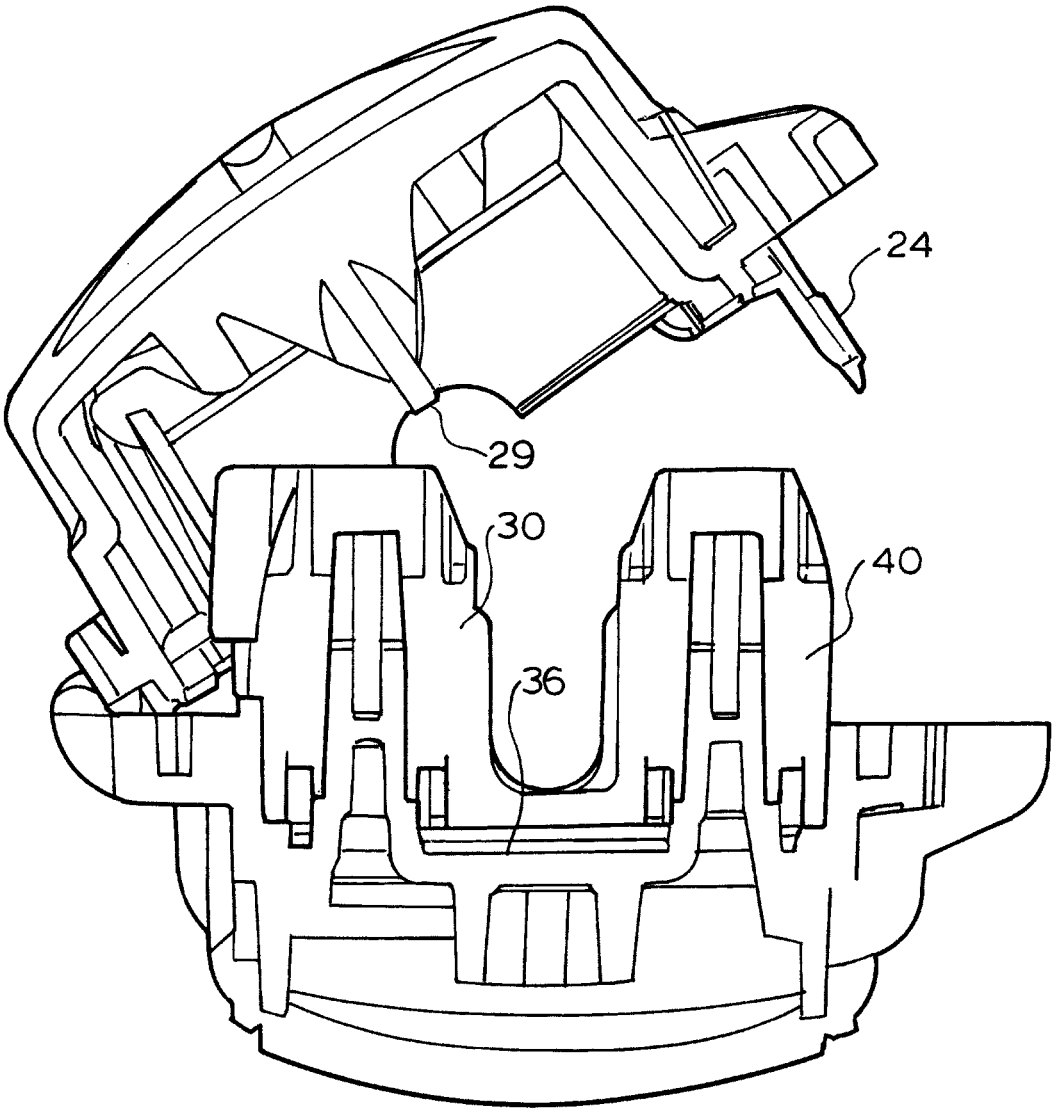
FIG. 12 is a side section view of FIG. 11.
Figure 13:
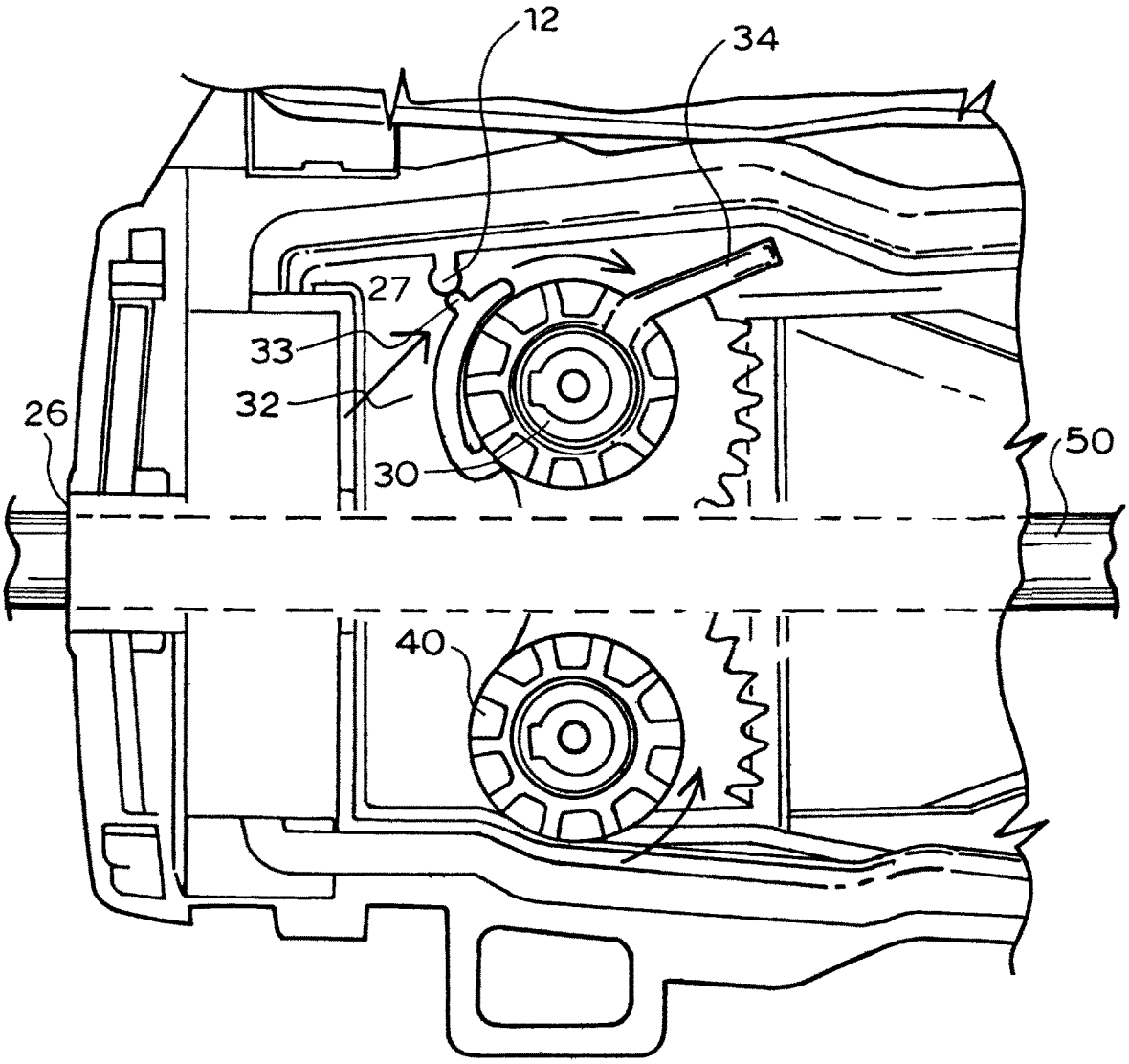
FIG. 13 shows a detail view of the electrical cord held in the cleat mechanism as the cover is closed.
Figure 14:
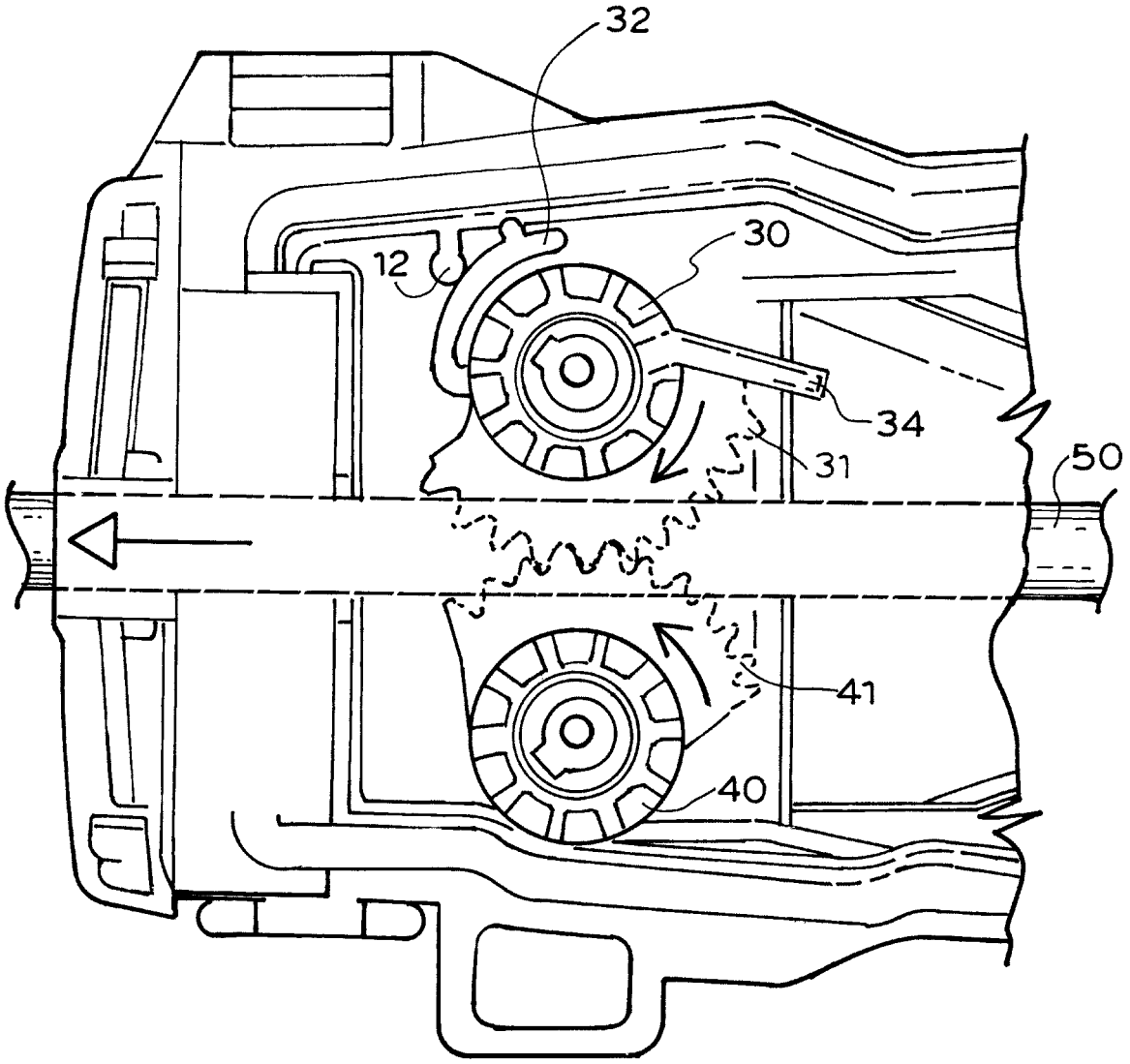
FIG. 14 illustrates the forces applied to the cord of a closed cover

To prevent forced removal of the leads from the cover a restraint mechanism is located in the body portion adjacent each end 15. The restraint mechanism consists of a master cleat 30 and a slave cleat 40 each with intermeshing gears 31, 41. The master cleat can be turned by the lever 34 and the spring 36 applies tension to the master cleat 30. As shown in FIGS. 10, 13 and 14, the electrical lead 50 passes between the master 30 and slave cleat 40 and is gripped between them.

Figure 8:
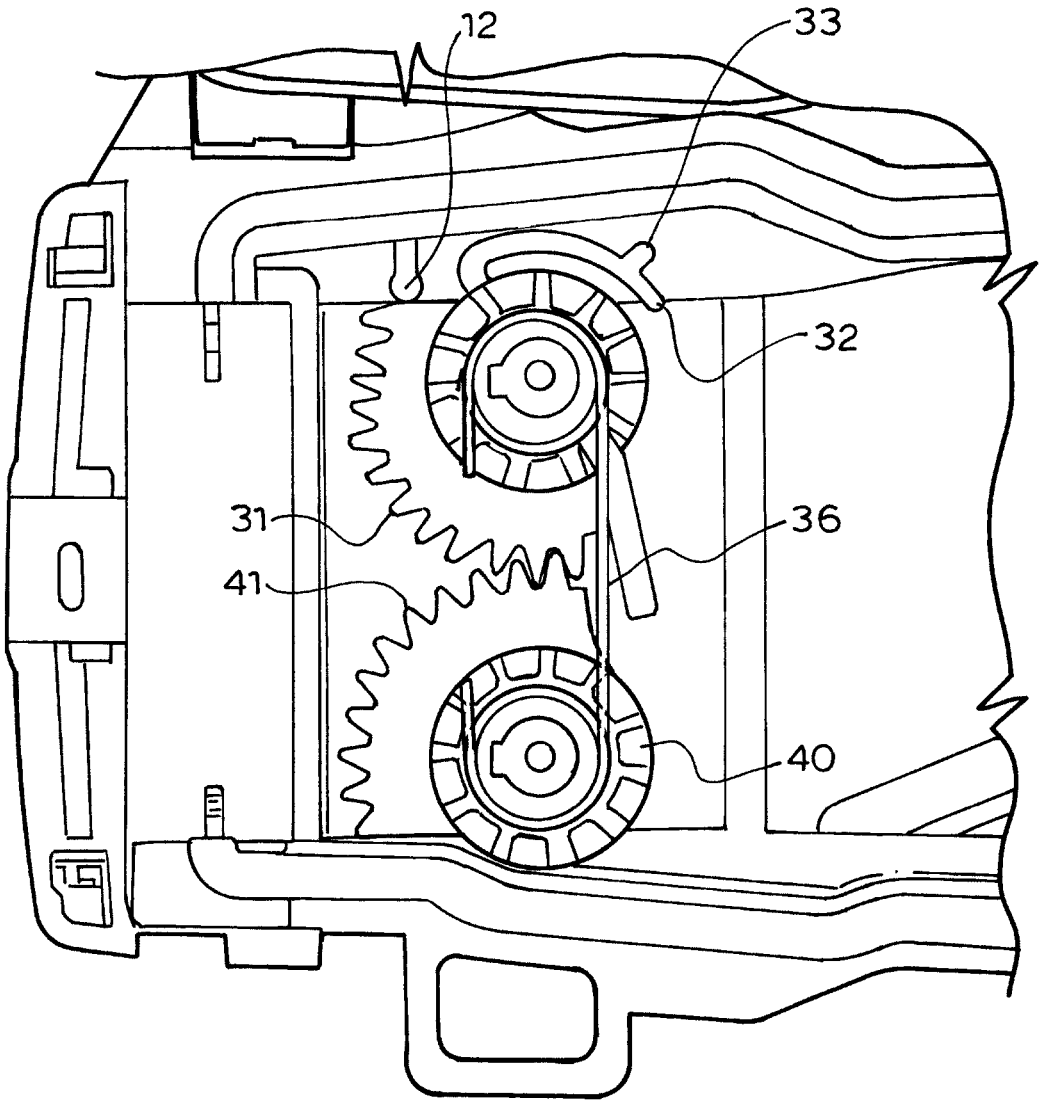
FIG. 8 shows a detail view of the components of the cleat mechanism.
Figure 9:
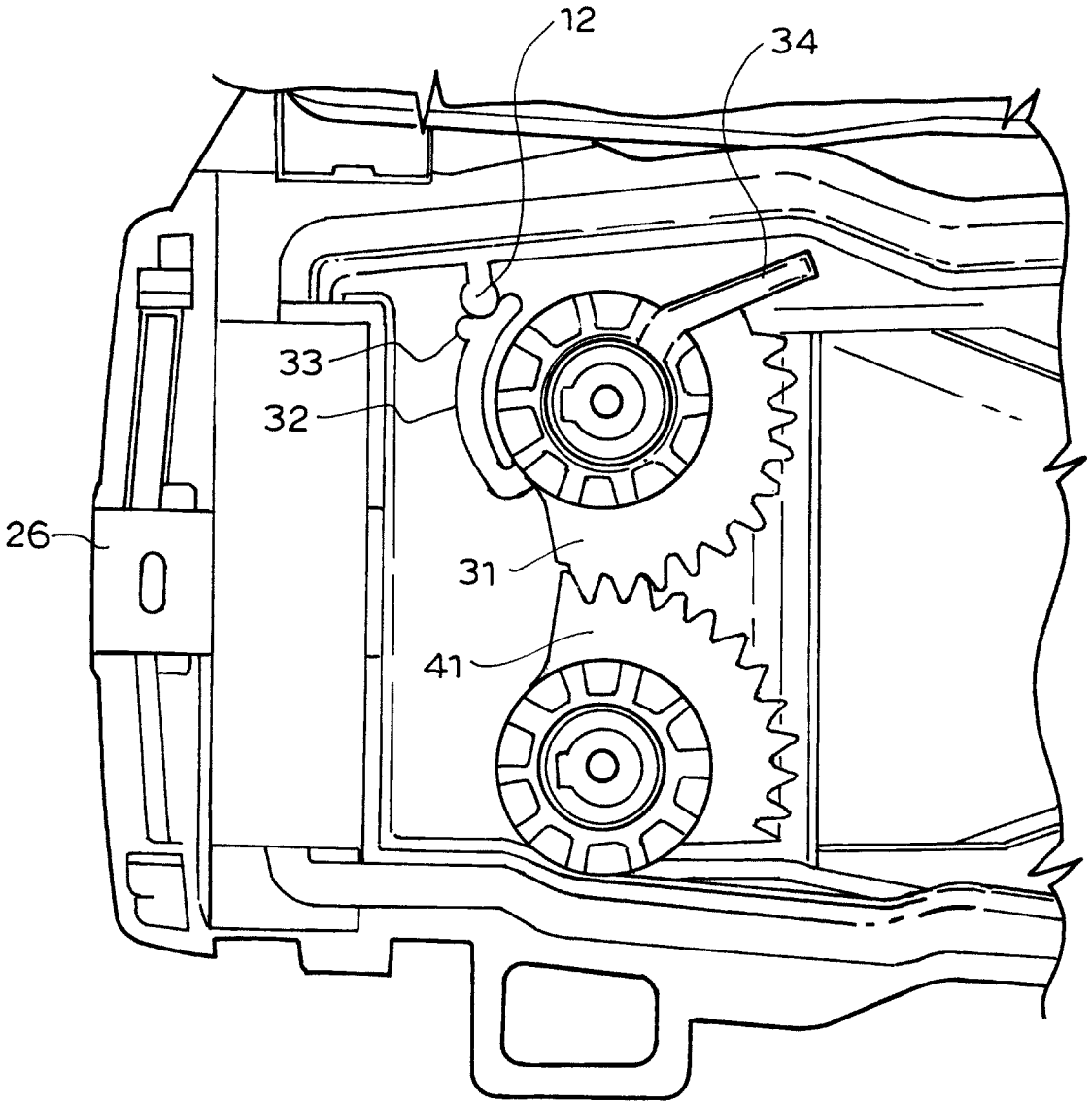
FIG. 9 shows a detail view of the operation of the cleat mechanism.
Figure 15:
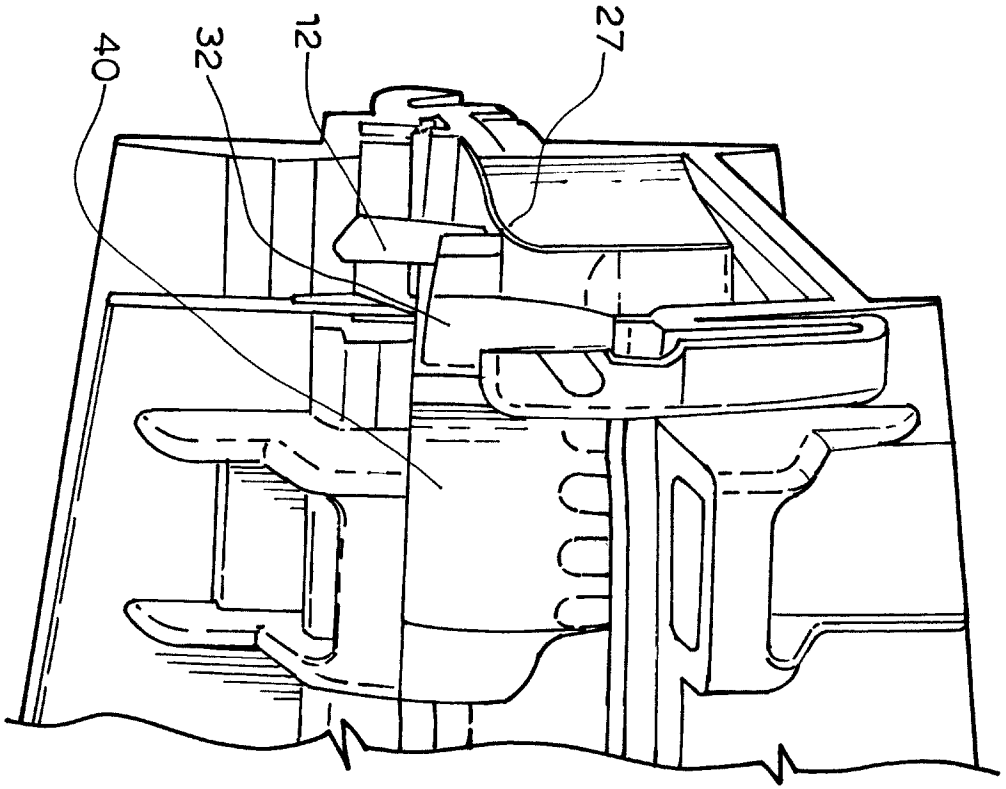
FIG. 15 shows a side section view as the cover is closed.
Figure 16:
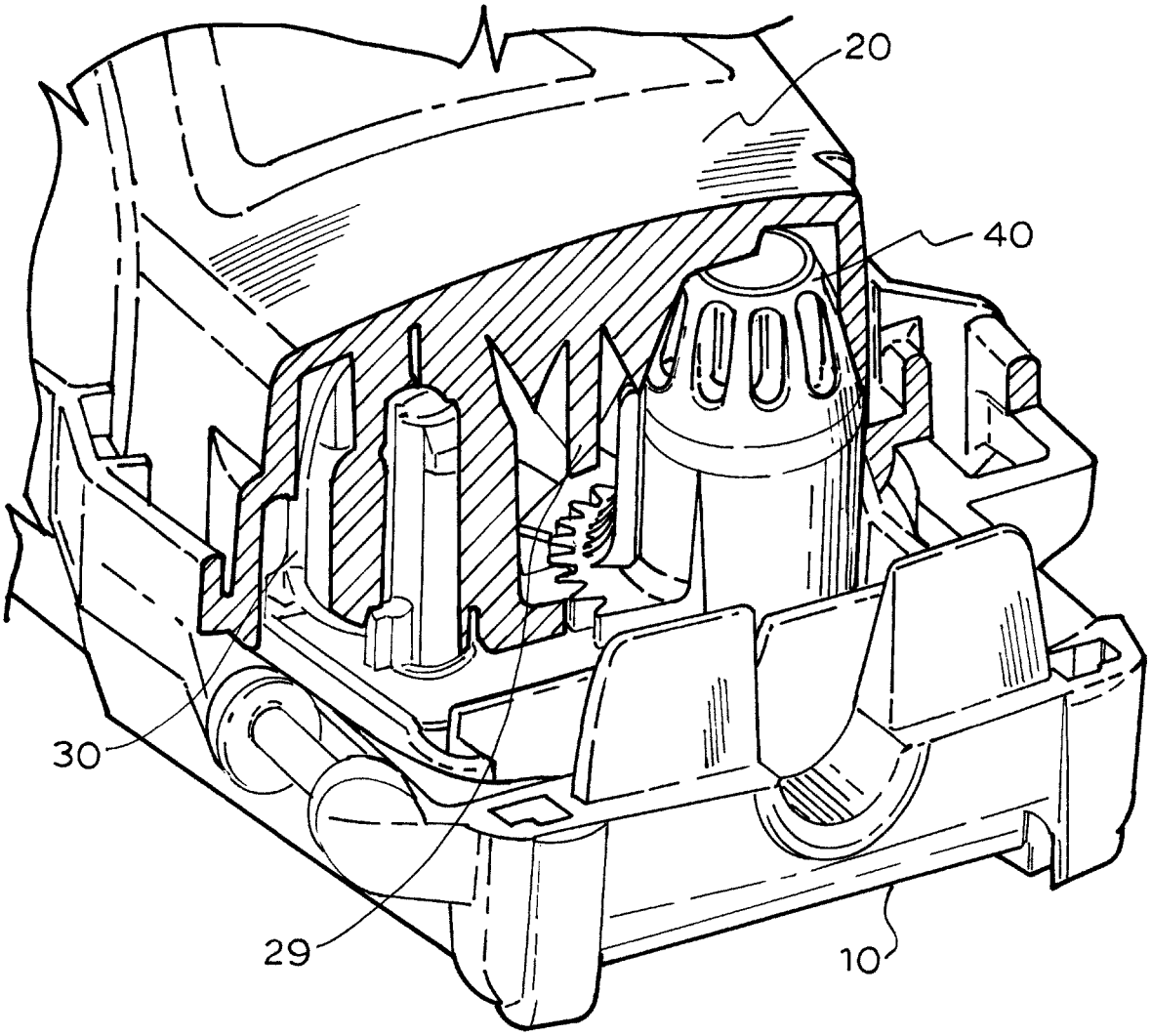
FIG. 16 is a cut away detail of the closed position.

The master cleat 30 carries a flexible arm 32 with its barb 33 that engages the post 12 of body 10 as shown in FIGS. 8 and 9 the movement of the lever 34 moves the flexible arm 32 past post 12, so that the barb 33 abuts post 12 to latch the restraint to allow the lead to be placed between the master cleat 30 and slave cleat 40 and in the half of aperture 26 in ends 15 of the body. When the lid 20 is closed the cammed surface 27 on the internal surface of lid 20 pushes the barb 33 away from post 12 so that the spring acts to rotate the master cleat 30 and slave cleat 40 to engage the surface of the lead 50 as shown in FIGS. 13, 14 and 15.

The mechanism releases the cleats automatically when the lid is closed. The cleats have to latch during use, otherwise it would be very awkward to insert the lead with two pairs of cleats. The mechanism uses no extra parts to achieve this.

Figure 17:
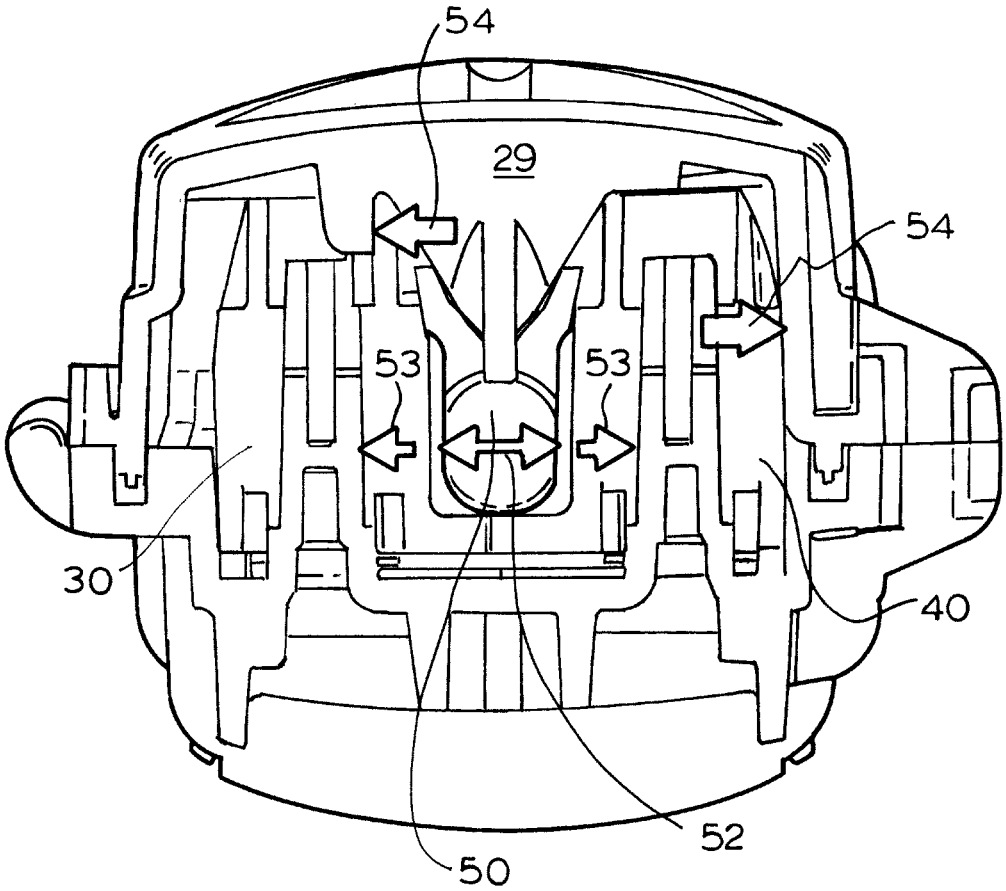
FIG. 17 illustrates the forces in the closed position.

The outward force 52 on the cleat is shared between post and upper housing to resist very high loads as illustrated in FIG. 17.

The cleats 30 and 40 are mounted equidistant from axis of force (the electrical lead 50 that is to be retained) on two plastic bosses. The cleats 30 and 40 are positioned up from the base of the bosses to allow room for the spring 36 which creates the pre-tension. As shown in FIG. 17 this distance may create an issue as these bosses may have a longer lever arm, allowing them to bend under force 53. To counteract this the cleats are additionally supported higher up by bearing points 54 in the upper housing when under load. Some or all of the force acting on the cleat is shared with the enclosure. This keeps them in position under a much higher force than if they were only supported by the bosses.

The cleats 30 and 40 are geared together, so opening one also opens the other.

This also keeps the lead 50 centralised, as it has to be positioned in the centre of the aperture 26 seal for this to work.

There is a web 29 on the lid that fills up the space between the cleats 30 and 40 when closed, to stop the lead potentially riding up on the cleats under high forces.

The cleats are injection moulded so the teeth aren't parallel, but camber outwards to the opening on top.

Those skilled in the art will realise that this invention provides a unique, convenient and cost effective solution to the provision of a water tight cover for electrical plugs and sockets Those skilled in the art will also realise that this invention can be implemented in embodiments other than that described without departing from the core teachings of the invention.

The invention claimed is:

1. A cover device for an electrical plug and socket junction, the cover device comprising:

two parts that are able to be arranged to configure the cover device in an open configuration or a closed configuration;

a space defined between the two parts that is able to accommodate an electrical lead that is coupled to a plug or socket connector; and a spring biased lead restraint mechanism within the space between the two parts, wherein the spring biased lead restraint mechanism includes at least one rotatable cleat that is spring biased to rotate into engagement with the lead when the cover device is in the closed configuration, thereby to prevent movement of the lead when the cover device is in the closed configuration without applying tension to the attachment of the lead to the plug or socket connector.

2. The cover device according to claim 1 wherein the two parts are hinged along one longitudinal side and able to be clipped together on the opposite longitudinal sides.

3. The cover device according to claim 1 wherein the cover device-comprises:

a hinge section joining the two parts along adjacent longitudinal edges; and fastening means on the longitudinal edges opposite the hinge edges to securely close the cover device.

4. The cover device according to claim 1 wherein the rotatable cleat is able to be locked into a lead receiving position in which it is latched against the spring bias.

5. The cover device according to claim 4 wherein at least one of the two parts is shaped thereby to, upon progression of the device into the closed configuration, mechanically release the rotatable cleat from the receiving position such that the spring bias rotates the cleat into engagement with the lead.

6. The cover device according to claim 1 wherein two rotatable cleats located on either side of the lead, said cleats incorporating gear teeth which intermesh so that the cleats rotate synchronously under tension of a spring and engage the surface of the lead.

7. The cover device according to claim 6 wherein some or all of the force acting on the cleats when the cover device is closed, is shared with the two parts of the cover device.

8. The cover device according to claim 1 wherein the cover device is weatherproof to thereby protect interior elements when the cover device is in the closed configuration.

9. The cover device according to claim 8 wherein the cover further comprises an aperture through which the lead extends when the device is in the closed configuration, wherein the two parts include respective formations which form a weatherproof seal around the lead.

10. The cover device according to claim 9 wherein the respective formations which form a weatherproof seal around the lead require the lead be positioned centrally with respect to the formations, and wherein the spring biased lead restraint mechanism is configured to maintain the lead centrally when the device is in the closed configuration.

11. The cover device according to claim 1 wherein the space defined between the two parts is configured to contain an electrical plug and socket junction, wherein at least one of the electrical plug or socket is coupled to the lead.

12. The cover device according to claim 1 wherein the spring biased lead restraint mechanism prevents outwards longitudinal movement of the lead from the cover device, but allows inwards longitudinal movement of the lead into the cover device.

13. The cover device according to claim 1 wherein the spring biased restrain mechanism is actuated by the closing of the cover device.

* * * * *